US005764260A

United States Patent [19]

Vu et al.

[11] Patent Number: 5,764,260

[45] Date of Patent: Jun. 9, 1998

[54] REUSABLE INKJET CARTRIDGE ADAPTOR

[75] Inventors: Robert B. Vu; James D. Story; Troy Scott Thomas, all of Houston, Tex.

[73] Assignee: JetFill, Inc., Houston, Tex.

[21] Appl. No.: 615,141

[22] Filed: Mar. 14, 1996

[51] Int. Cl.[6] ..... B41J 2/175

[52] U.S. Cl. ..... 347/87

[58] Field of Search ..... 347/84, 85, 86, 347/87, 49, 108

[56] References Cited

U.S. PATENT DOCUMENTS 4,703,332 10/1987 Crotti et al. ..... 347/87
5,512,926 4/1996 Uchikata et al. ..... 347/86
5,663,753 9/1997 Story et al. ..... 347/86

FOREIGN PATENT DOCUMENTS 5-318758 12/1993 Japan ..... 347/86

*Primary Examiner*—Benjamin R. Fuller
*Assistant Examiner*—Judy Nguyen
*Attorney, Agent, or Firm*—Pravel, Hewitt, Kimball & Krieger

[57] ABSTRACT

An improved method and apparatus for modifying an inkjet cartridge for the use of separable ink reservoirs including a base plate designed to be snap fitted into a hollowed out cartridge shell and lever mechanism that cooperates with the base plate to enable the separable reservoir to fit different sizes of cartridges and to be easily removed from the cartridge.

2 Claims, 2 Drawing Sheets

FIG.4
FIG.3
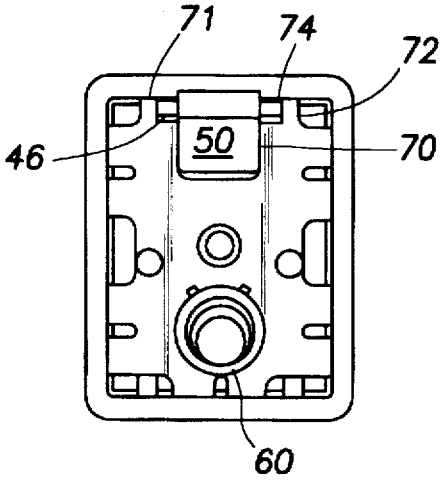
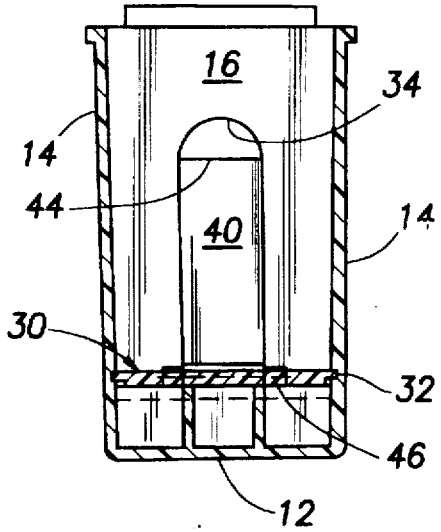
FIG.5
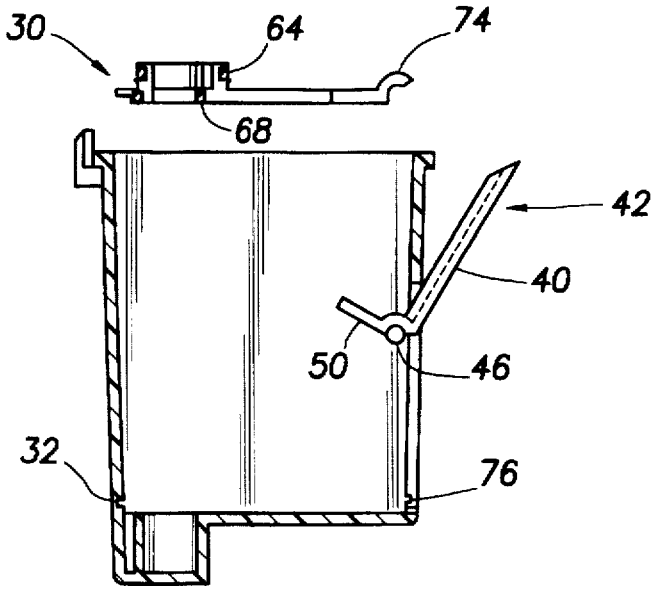

REUSABLE INKJET CARTRIDGE ADAPTOR

FIELD OF THE INVENTION

The present invention relates to a recording apparatus and, more specifically, to a disposable inkjet cartridge which has been modified to be reusable.

BACKGROUND OF THE INVENTION

Ink jet cartridges such as those used in inkjet printers, facsimiles, postal meters and other recording devices are generally well known in the art. Such cartridges comprise an integral ink container containing liquid ink to be supplied to the printhead. Ink from the ink container is supplied to the printhead through a series of microchannels, where the ink is heated, charged, or pumped causing it to be expelled through the printhead onto a recording sheet.

There are several known inkjet cartridge and reservoir configurations that generally fall into two categories. Those designed for inkjet recorders that have a permanent printhead and use replaceable reservoirs, or ink supplies and those which require cartridges which have both a printhead and an ink reservoir.

Printheads are expensive relative to ink reservoirs, and have a limited life as they tend to degrade or clog over time. The useful life of a printhead exceeds, however, the volume of ink supplied with a cartridge having an integral printhead.

On the other hand, a permanent printhead within an inkjet recording device will eventually require replacement, a maintenance procedure which cannot be done by an ordinary user and approaches the cost of some new inkjet recorders. Thus cartridges with disposable print heads are advantageous, even though they typically cost four or more times the cost of a reservoir without a printhead.

To address the lack of economy as well as environmental concerns with prematurely discarding cartridges having integral printheads when the ink is depleted, refillable cartridge systems have been developed. Refill manufacturers purchase ink jet cartridges having an integrated ink reservoir, hollow out the ink reservoir leaving the shell of the cartridge containing the printhead and print circuitry for receiving electrical signals from the printer, and provide an insertable ink container that fits within the hollowed out cartridge to enable the end user to reuse the cartridge until the printhead no longer functions in an acceptable manner.

As can be appreciated, it is desirable to maximize the volume available for ink within the insertable ink container and there must be a leak proof seal between the ink container and the cartridge shell. For these reasons, removing an empty container with a tight friction fit between the shell and container can result in spilling ink during the removal process. It would therefore be desirable to have a container which is easy to remove but still provides ample ink capacity and a good seal between the container and the print head. In addition, to accommodate design changes in cartridge shells without having to redesign insertable ink containers, it would be advantageous to provide a means for adapting containers to minor variations in cartridge shell dimensions or designs.

The present invention involves taking an inkjet cartridge which includes both a disposable printhead and an ink container or reservoir, and modifying the cartridge to accept additional ink containers, enabling the printhead to be used with multiple ink charges rather than a single ink charge. The present invention provides an improved cartridge modification which both enables the ink container to fit within the cartridge in sealing engagement with the ink discharge port of the cartridge and a mechanism for easily removing an empty ink container for replacement with a freshly charged container.

SUMMARY OF INVENTION

The present invention addresses the sealing and removal problem of prior art inkjet cartridge shell modifications as well as providing flexibility to adapt an ink container to minor shell dimension variations by providing an insertable base plate and means for securing the plate in overlying relationship to the bottom wall of the shell. For additional ease in removing spent ink cartridges, the invention provides a lever mechanism and a further shell modification to accommodate the lever mechanism.

In particular, the present invention includes the modification of a disposable inkjet cartridge comprising a printhead and an ink supply into a reusable cartridge shell comprising both a semipermanent printhead and an adapter for accepting disposable ink reservoirs. To modify the cartridge into the reusable shell, a top portion of the cartridge is removed and the original reservoir area within the cartridge is cleared. If necessary, the bottom interior surface of the cartridge is leveled. The shell is then further modified to accommodate the adapter base plate and lever mechanism of the present invention. In a preferred embodiment, the shell is provided with a groove milled into an interior wall adjacent to a bottom interior surface of the cartridge, so that the base plate adapter of the invention can be snap fitted within the groove. The base plate adapter includes a means for fluidly coupling the disposable ink reservoir with the shell's printhead.

Another feature of the invention is the provision of a lever mechanism having a short arm for fitting within a groove in the base plate and a long arm for fitting with a groove in a sidewall of the cartridge shell such that movement of the long arm away from the shell causes the short arm to act as a wedge to push the disposable ink reservoir up within the shell for easy removal from the shell. To accommodate this feature, the shell is further modified by cutting or milling a groove in a sidewall of the shell so that the long lever arm is flush with the sidewall when the reservoir is in use but can be moved outwardly when the reservoir is depleted for ease in removing the spent reservoir.

BRIEF DESCRIPTION OF THE DRAWINGS

FIG. 3 is a plan view of a base plate according to the present invention which has been configured for use with an HP51626A cartridge shell.

FIG. 4 is an end view of a modified ink cartridge shell showing the cutout for the lever mechanism of the present invention with the lever mechanism inserted within the cutout.

FIG. 5 is an exploded view of a shell modified in accordance with the invention illustrating assembly of the adapter into the shell.

DETAILED DESCRIPTION OF A PREFERRED EMBODIMENT

Figure 1:
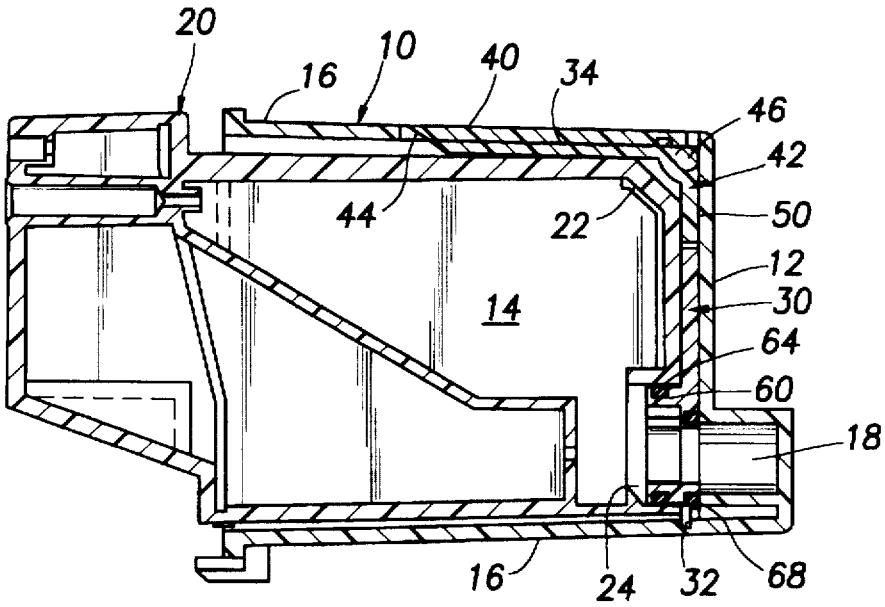
FIG. 1 is a side cross sectional view of a modified ink cartridge shell illustrating the base plate and removal lever features of the present invention.
Figure 2:
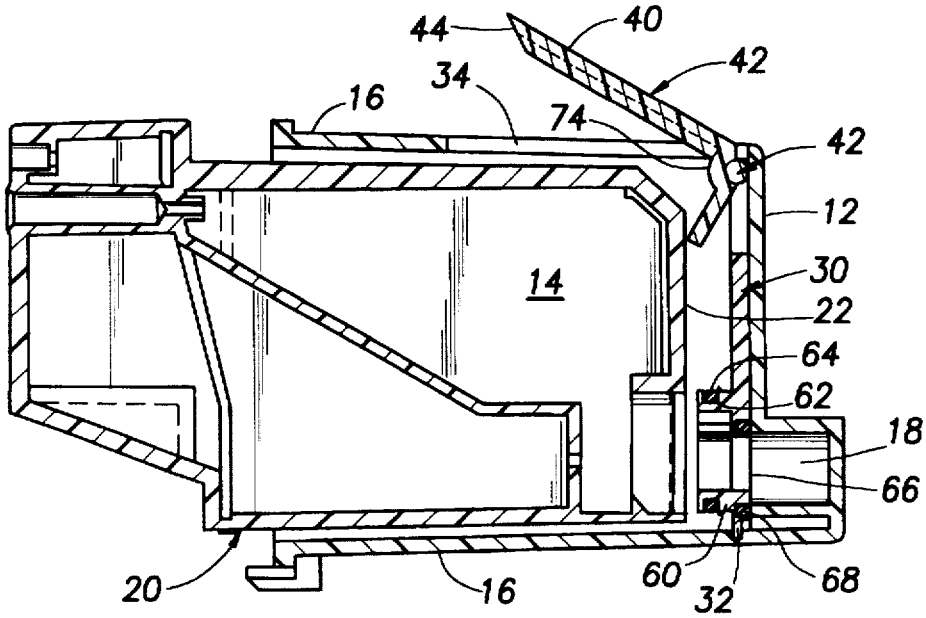
FIG. 2 is a view similar to FIG. 1, illustrating the removal lever activated to displace the ink cartridge prior to removal.

The invention may best be understood with reference to the embodiment shown in the Drawing. With reference to FIGS. 1 and 2, there is shown a modified cartridge shell 10 having a bottom wall 12, opposing major side walls 14, and opposing minor sidewalls 16, and an ink exit port 18. A removable ink reservoir 20 is shown having a bottom wall 22 and major and minor sidewalls sized to fit within the cartridge shell, and having an ink exit port 24 formed within its bottom wall 22. In accordance with one feature of the invention, base plate 30 is provided for insertion between the reservoir bottom wall 22 and the shell bottom wall 12. Although the plate 30 may be secured within the shell 10 in any suitable manner, such as by gluing or welding, it is preferred that the shell 10 be further modified by providing a circumferential groove 32 in the shell's sidewalls 14 and 16 adjacent its bottom wall 12 and the spacer plate 30 sized to snap fit within the groove 32.

In accordance with a second feature of the invention, the shell 10 is further modified to include a notch 34 in one shell sidewall, e.g. by milling a cutout in minor sidewall 16, shown best in FIG. 4, to receive operable lever arm 40 of the lever mechanism 42.

Turning first to the details of the lever mechanism 42, it can most conveniently and economically be formed as a single injection molded plastic piece with the long operable lever arm 40 having a beveled top edge 44 so that it can easily be pulled away from its rest position within the shell sidewall notch 34. The base of the operable lever arm 40 can be shaped to form a hinge pin 46. A short lever arm 50 perpendicular to the long arm 40 completes the lever mechanism 42 which is designed to cooperate with the base plate 30, as will be more fully appreciated in light of the following discussion.

The features of the base plate 30 are best shown in FIGS. 2 and 3. To provide a fluid seal between the exit port 18 of the shell and the exit port 24 of the reservoir, the base plate 30 includes internally extending flange 60 sized to fit within the reservoir exit port 24. The flange 60 includes a seal groove 62 for receiving an O-ring 64 to complete the fluid seal between the base plate flange 60 and the reservoir's port 24. To provide a seal between base plate exit port 66 and the shell port 18, the base plate includes a second seal groove in its bottom surface for receiving a second O-ring 68.

To work with the lever mechanism, the base plate 30 also includes a major cutout 70 along its minor edge 71 sized to surround the short lever arm 20. To capture the hinge pin 46 of the lever mechanism 42 and provide the hinged function for the lever mechanism 42, the base plate 30 also includes minor cutouts 72 on either side of the major cut out 70 for receiving and containing the distal ends of the hinge pin 46 within the base plate 30. The base plate 30 also includes an arcuate extension 74 formed along the remaining length of its minor edge 71 which effectively captures the lever mechanism 42 within the base plate 30 and permits it to pivot by way of its hinge pin 46 from its flush position shown in FIG. 1 to its extended position shown in FIG. 2 to effectively push the reservoir 20 out of engagement with the O-ring 64 and out of the shell 10 for easy removal and replacement of the reservoir 20. As can now be appreciated, to accommodate the distal end of the arcuate extension 74, an additional groove or notch 76 is cut or milled in the shell sidewall 16 to complete the secure snap fit between the base plate 30 and the shell 10.

Although the present invention and its advantages have been described in detail, it should be understood that various changes, substitutions and alterations can be made herein without departing from the spirit and scope of the invention, as defined by the following claims.

What is claimed is:

1. An adapter for use in a replaceable ink container system having an ink cartridge shell wherein the shell includes a bottom wall containing an exit port for egress of ink from the shell and wherein the system further includes a separable ink container having an ink exit port corresponding to the exit port of said bottom wall, said adapter comprising:

a lever mechanism including a first arm sized to fit within an opening in a side wall of the shell;

a second arm;

a hinge pin having distal ends and joining the first arm and the second arm at substantially right angles to one another; and a base plate shaped to fit within the shell in overlying relation to the bottom wall of the shell, in surrounding relationship to the second lever arm, in close fitting relationship with the distal ends of the hinge pin, in surrounding relationship with the exit port of said bottom wall, in fluid seal engagement with the exit port of said bottom wall, and in sealing engagement with the ink exit port of said container.

2. A replaceable ink container system, comprising:

an ink cartridge shell, the shell having a side wall and a bottom wall, the side wall having an opening and the bottom wall having an exit port for egress of ink from the shell;

a separable ink container within the shell, the container having an exit port corresponding to the exit port of said bottom wall; and an adapter for fluid coupling of the container with the shell, the adapter comprising:

a plate size to fit securely within the shell atop said bottom wall, the plate having a flange sized to fit within the exit port of said container, the plate having an opening sized to correspond with the exit port of said bottom wall;

means for fluid seal engagement between the flange of said plate and the exit port of said container;

means for fluid seal engagement between the opening of said plate and the ink exit port of said bottom wall; and a lever mechanism, the lever mechanism including:

a first arm being sized to fit within the opening of said side wall;

a second arm, and a hinge pin having distal ends and joining the first arm and the second arm, wherein the plate includes a cut out for receiving the second arm and pivotally engaging the distal ends of the hinge pin.

* * * * *